United States Patent [19]

Pedretti et al.

[11] Patent Number: 4,555,823

[45] Date of Patent: Dec. 3, 1985

[54] MACHINE FOR THE AUTOMATIC CARDING OF UPPERS FOR FOOTWEAR

[75] Inventors: Gaetano Pedretti, Vigevano; Paolo Marazzi, Torlino Vimercati, both of Italy

[73] Assignee: Cerim, S.P.A., Torlino Vimercati, Italy

[21] Appl. No.: 525,558

[22] Filed: Aug. 22, 1983

[30] Foreign Application Priority Data

Aug. 30, 1982 [IT] Italy ..... 23043 A/82

[51] Int. Cl.[4] ..... A43D 95/00; C14B 1/44

[52] U.S. Cl. ..... 12/77; 69/6.5

[58] Field of Search ..... 12/70, 70.5, 77, 78, 12/85, 85.1, 85.3, 52.5; 69/6.5

[56] References Cited

U.S. PATENT DOCUMENTS

| | | | |
|---|---|---|---|
| 2,249,742 | 7/1941 | Brostrom | 12/77 |
| 2,730,735 | 1/1956 | Hannable et al. | 12/85.1 |
| 3,843,985 | 10/1974 | Leonhardt | 12/77 |
| 3,975,932 | 8/1976 | Vornberger | 12/77 |
| 4,126,027 | 11/1978 | Tutt et al. | 12/77 |
| 4,134,278 | 1/1979 | Becka | 12/77 |

FOREIGN PATENT DOCUMENTS

| | | | |
|---|---|---|---|
| 1007861 | 10/1976 | Italy . | |
| 104318 | 4/1924 | Switzerland | 12/70 |
| 1234934 | 6/1971 | United Kingdom | 12/77 |

*Primary Examiner*—Werner H. Schroeder
*Assistant Examiner*—Steven N. Meyers
*Attorney, Agent, or Firm*—McAulay, Fields, Fisher, Goldstein & Nissen

[57] ABSTRACT

A machine for the automatic carding of uppers for footwear, having a locking unit of the last formed by two parts, one for locking the last in the heel-zone and the other to support the toe, and positioned on a carriage movable on a bedplate; a template positioning system connected to a lifting unit; a fixed tool-holder unit provided with a rocking arm having a free end with a tool fixed thereto; two similar tool-holder units movable in a transverse direction relatively to the axis along which the carriage slides and symmetrically positioned with reference to the symmetry axis of the bedplate, each tool-holder unit being provided with a tool fixed to the free end of a rocking arm whose work pressure on the upper may be suitably regulated; and a profile-copying system for controlling the movement of the two movable tool-holder units in accordance with the contour of the template.

17 Claims, 6 Drawing Figures

MACHINE FOR THE AUTOMATIC CARDING OF UPPERS FOR FOOTWEAR

DESCRIPTION OF THE INVENTION

The present invention is related to a machine for the automatic carding or scraping of uppers for footwear; i.e. it prepares the face, formed by the insole and the upper folded and fixed on the insole, on which the sole is subsequently stuck or glued.

It is well known that, to obtain a perfect bonding by means of a suitable adhesive between sole and upper, the part of the upper to be glued to the sole must be made rough and coarse. Automatic machines performing the operation on the upper are already known, but they have some drawbacks, namely an inadequate productivity, operating difficulties when using very delicate or synthetic leathers, difficulties in the arrangement of the templates for the copying operation, etc.

The object of this invention is to provide an inexpensive machine exempt from the aforesaid drawbacks, and having moreover other advantages. According to the present invention, these objects are obtained by a carding machine comprising: a main carriage sliding along the longitudinal axis of the machine, provided with positioning and locking means for the last of the upper, and with a positioning and fastening system for a stack of templates, comprising a complete set of profiles corresponding to the contour of the lasts or the insoles, with right and left shapes alternatively inserted, and related to a definite type of footwear; this stack of templates, placed onto a platform with vertical sliding guides, is sustained by a group of cylinders in series, which, when suitably actuated, move the template corresponding to the specific last used in that manufacturing cycle to the level of the feeler pins of a profile-copying device, as described in the Italian Pat. No. 1,007,861. On two carriages, placed at the sides of the main carriage and sliding along an axis orthogonal to that of the main carriage, are positioned two rocking arms, provided at their free ends with circular tools or cards, as steel-wire brushes of a suitable diameter, operated by a belt driven by an electric motor also positioned on each carriage.

The arms are moreover provided with means to adjust the brush pressure on the upper, and with approach and stop controls; an electro-hydraulic profile-copying system including a feeler pin, a position transducer, an electronic processor, an hydraulic valve and hydraulic motor, drives the carriage, and consequently the tool connected to the carriage by means of the rocking arm, along a trajectory exactly like that of the template contour with which the feeler pin is in touch, the machine being conceived in such a way that, when the main carriage in its work movement, brings the template in touch with the feeler pin of the copying system, the carding tool comes in touch with the last carrying the upper.

The carriage trajectory may be somewhat modified, when using the same template, by means of suitable adjustments. On the bedplate, in a fixed position, is arranged a rocking arm parallel to the longitudinal axis of the machine, provided with means for adjusting the work pressure and for adjusting the approach movements, which carries at its free end a tool rotating at high speed and protruding laterally from said arm, the rotation axis of said tool being at a right angle with the sliding direction of the main carriage. This additional tool is intended to rasp or scrape, before the carding tools begin to work, the big lumps that are frequently found on the toe and/or the heel zone of the last, due to the adhesive and to sizable folds in the upper.

The work cycle of the machine is the following: first of all, the stack of templates relative to the lasts used in the actual production is positioned on the machine, the adjustments of the work pressure of the card on the upper are carried out, and so are the adjustments of the tool trajectory relatively to the template contour; the template corresponding to the number or size of the shoe actually manufactured is selected, and the last with the upper is placed on the machine.

The locking system automatically moves the last to the required height, and identifies the last if it is right or left, and selectes the correct template to be brought in touch with the feeler pin of the profile-copying system.

Then the machine performs the carding, having previously scraped the tufts or lumps with the front tool, and when the work cycle is completed, opens the locking means of the last, so enabling the operator to easily remove it and to put in place the next one.

The construction and functional features of the machine for the automatic carding of footwear uppers, object of the present invention, may be better explained by the following description, where reference is made to the figures of the attached drawings, representing a preferred embodiment, as a non limitative example, and where:

DESCRIPTION OF THE PREFERRED EMBODIMENTS

Figure 1:
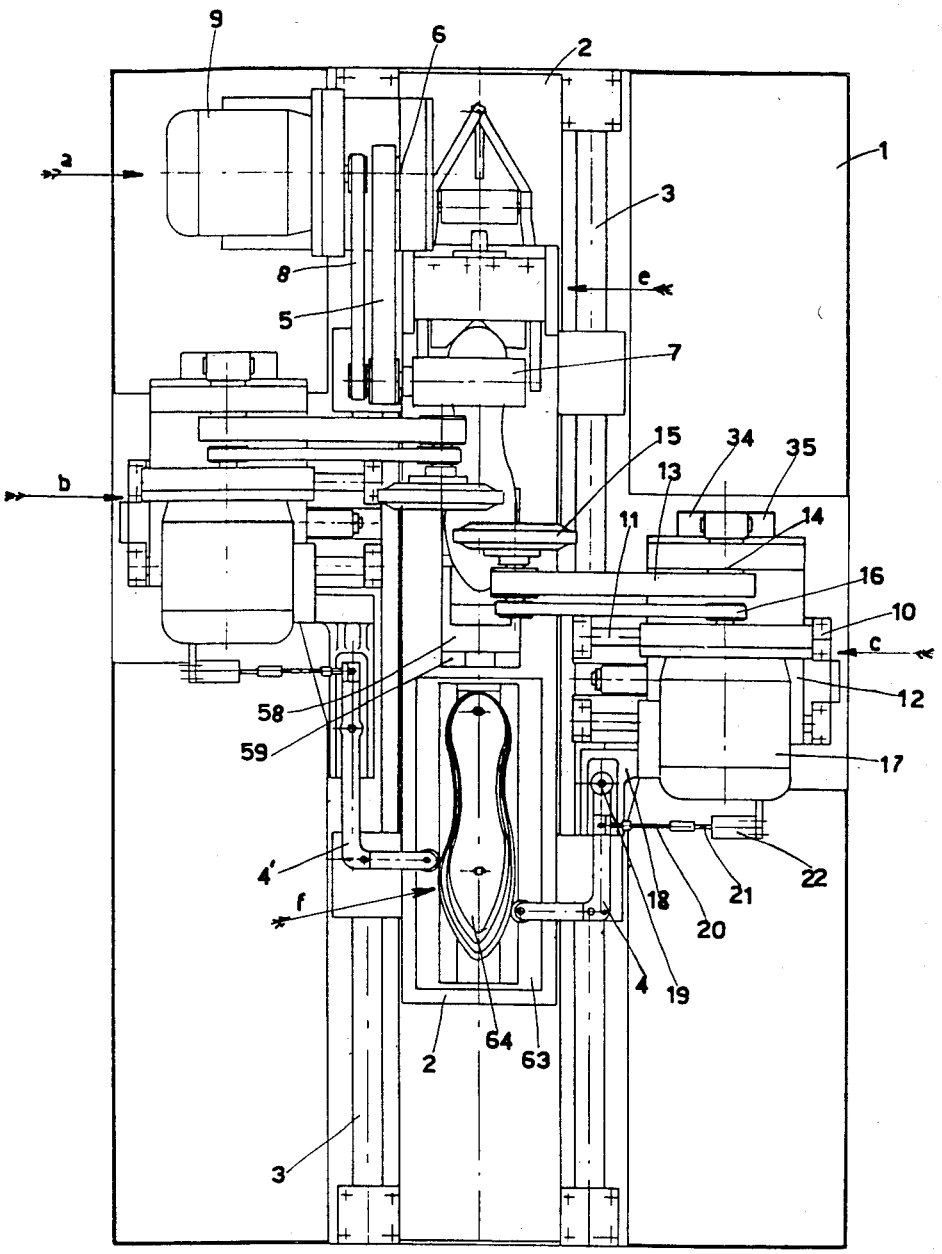
FIG. 1 represents a schematical plan view of the machine forming the subject of the present invention.

With reference to FIG. 1, on the bedplate 1 slides, carried by the guides 3, the main carriage 2, on which are positioned the locking device of the last e and the template stack with the lifting device f.

The bedplate carries besides three tool-holder units; the first a, fixed, is arranged to perform the coarse rasping or scraping of the eventual tufts or lumps originated by an excess of thermoplastic material or by sizable folds of the upper; the second and third units, b and c, movable in a transverse direction relatively to the axis along which the main carriage slides, are arranged to perform the carding of the upper's outside band. The two units b and c, by means of feeler-pins 4 and 4', and of a profile-copying system afterwards specified, follow the trajectory given by the template with which the feeler-pins are in touch.

Unit a is fixed and is provided with an arm 5 rocking around a pivot 6 by means of suitable bearings, which carries at its free end a tool 7. The tool may be a milling cutter with multiple blades, or a steel-wire brush of suitable diameter, or other suitable tools, and is rotated by means of a belt driven by a motor 9.

Arm 5 is provided with cylinders for its lifting and positioning at a suitable height, not shown in the drawings.

To prevent the disjunction, at the two extremities of the last, of the upper from the insole to which it is glued, the tool 7 rotates in such a way that the motion of its outer portion in touch with the upper has the same direction of the folding of the upper on the insole. To get this result, being the upper in the toe and heel parts bent in opposite senses, tool 7 has a given direction of rotation when it begins to work, and, when it reaches about half the length of the last, it reverses its rotation.

Units b and c are similar, and positioned in a perfectly symmetrical way with reference to the symmetry axis of the bedplate; therefore only one of the units is afterwards described.

On support 10, connected in a fixed way to the bedplate, are positioned the guides 11 on which carriage 12 slides; the carriage bears the arm 13, rocking around a pivot 14, by means of suitable bearings. At the free end of said arm 13 is positioned the carding tool 15, which is a circular steel-wire brush of suitable diameter. The brush is driven by the motor 17, through the belt 16.

Figure 2:
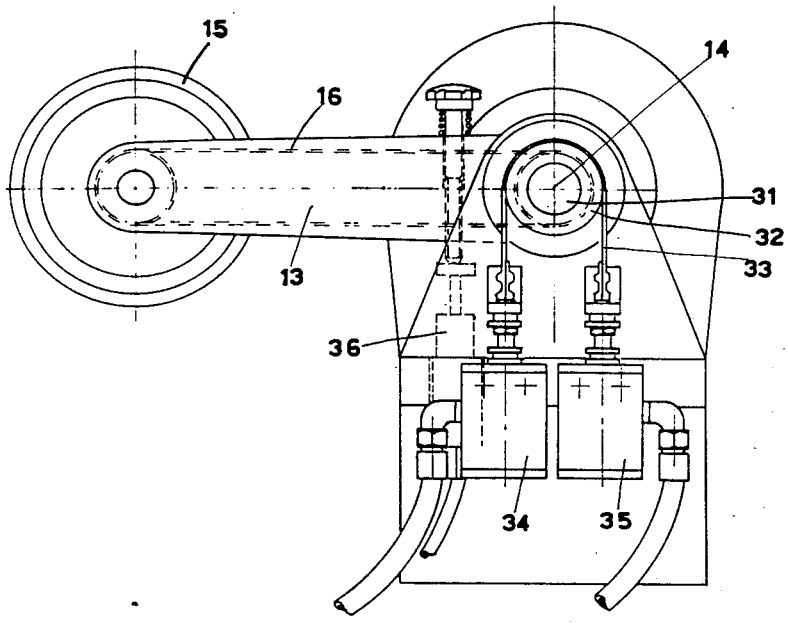
FIG. 2 represents a schematical perspective view of one of the two tool-holder carriages.

To adjust the relative pressure between carding tool 15 and the upper, the arm 13, as shown in FIG. 2, is provided, in position 14, with a pin 31 on which a pulley 32 is pivoted. On the pulley 32 acts the toothed belt 33 tensioned by two hydraulic actuators 34 and 35.

Actuator 34, normally kept at a low, constant pressure, with its pull towards the upper operates as a damper, i.e. it prevents the starting of vibrations on the carding tool, caused either by its possible slight eccentricity, and/or by the higher reliefs on the upper, which vibrations would negatively affect the work quality.

Actuator 35, on the contrary, performs the double function of relieving the load on the carding tool and of lifting it when the work cycle is completed. A third actuator 36 moves arm 13 into the initial work position, and retracts it when the carding tool is engaged with the upper.

A support 18, (see FIG. 1) integral with carriage 12, carries an arm 4 rocking around pivot 19. Arm 4 acts through the flexible shaft 20, on the slider 21 of transducer 22. Arm 4, moving along the contour of the template, acts on transducer 22, through the slider 21, and generates an electric signal, as it will be afterwards explained.

On a side of carriage 2 is positioned the locking unit of the last, performing besides the function of identifying if the last is right or left; the locking unit comprises two parts: one for the locking of the last in the heel area, and the other for supporting the toe.

Figure 3:
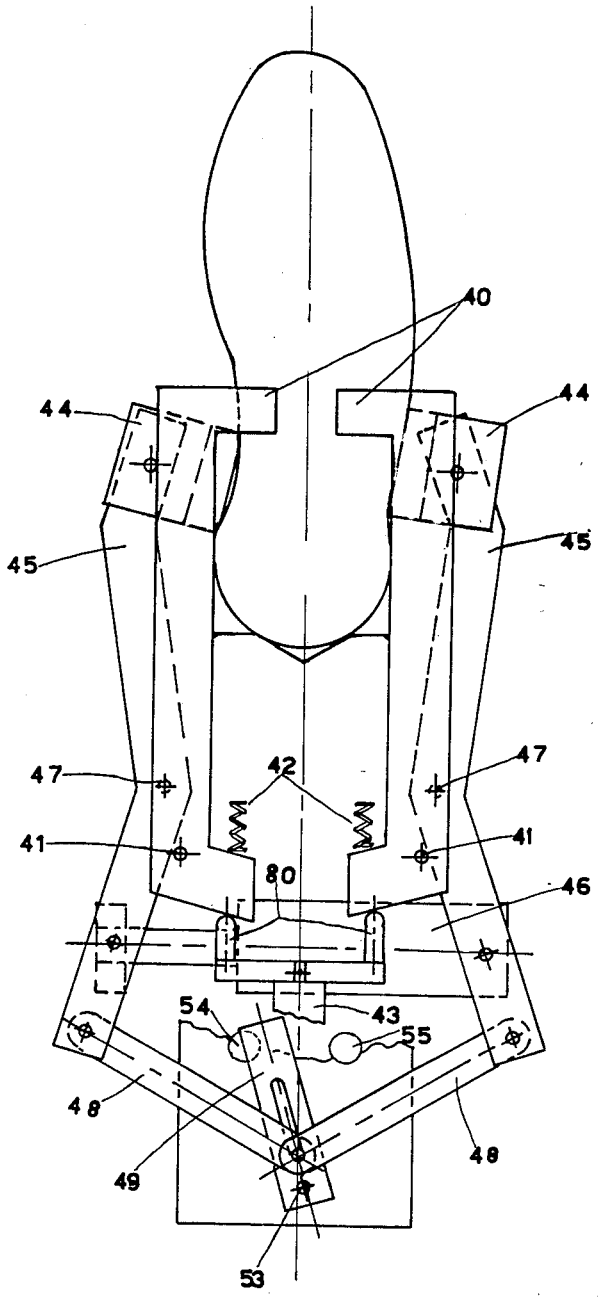
FIG. 3 represents the functional diagram of the last's locking device.

The locking of the last, its positioning at the required height and the identification if it is right or left, is performed by a system (see FIG. 3) comprising two arms 40, hinged in position 41 and pushed by the springs 42 in the closed position, while a piston 43, by means of its extensions 80, tends to open the arms, in a scissors-like manner.

Figure 4:
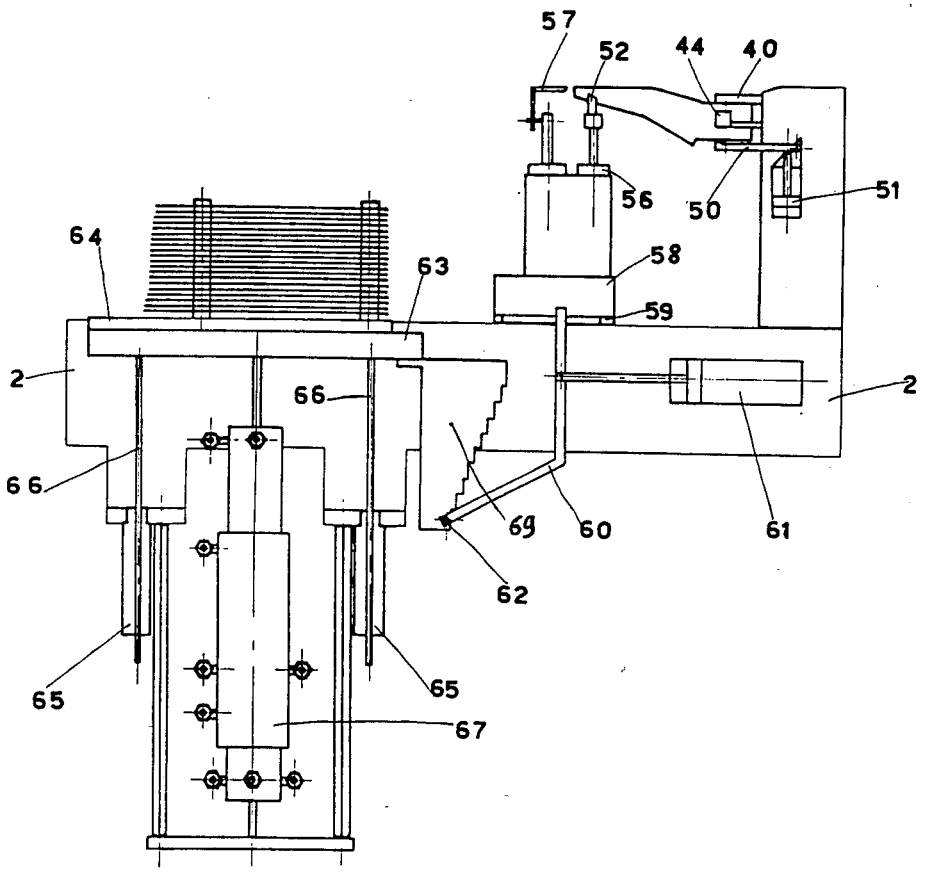
FIG. 4 represents the schematical view of the main carriage with the template stack including the guide and lifting system, and the front and rear locking device of the last.

The arms 40, together with lever 50, pushed by the actuator 51 shown in FIG. 4, perform the function of positioning the last at the required height. Acutally, inserting the last with the arms 40 closed, as in FIG. 3, and operating the actuator 51, the lever 50 pushes the last against the arms 40, which position the last at the proper height and in a level position; besides, the toe of the last, with fulcrum on the arms 40 and under the thrust of lever 50, wedges in forcefully on the toe support 52.

When the last is precisely positioned, pads 44, positioned on levers 45 with fulcrum in position 47, are operated; they under the thrust of actuator 46, tend to close, clamping the last and locking it for all the work cycle.

Besides, levers 45, given the asymmetry of the right last relatively to the left one, will place themselves asymmetrically relatively to the middle line of the system.

The displacement of levers 45, suitably amplified by the rods 48 and the arm 49, with fulcrum in position 53, causes the shifting of the arm to one side or to the other, according to the last actually used; and so, arm 49 operates alternatively the microswitchs 54 or 55. As soon as the carriage 2 begins its working stroke, arms 40 open, to clear the working area. The toe support 52 is provided with a V-cog where the toe wedges in; its height may be ajusted by means of the handwheel 56, and is controlled by lever 57. All the components are positioned on support 58, which may slide forward and back on the carriage, being carried by the guide 59.

It is obvious that the position of toe support 52 must be changed according to the lenght of the last; to obtain the change automatically, the support 58 is dragged, by means of arm 60, by the actuator 61. The arm 60 carries at its end the microswitch 62. The ladder 69, integral with the support 63 of the template stack 64, is provided with as many steps as are the couples of right and left templates that may be assembled on the stack.

The height of every step corresponds to two time the pitch of the templates, while the depth of the steps shall be different, according to the use of French or English numbers, and is equal to the difference in length between two subsequent numbers of shoes.

Figure 5:
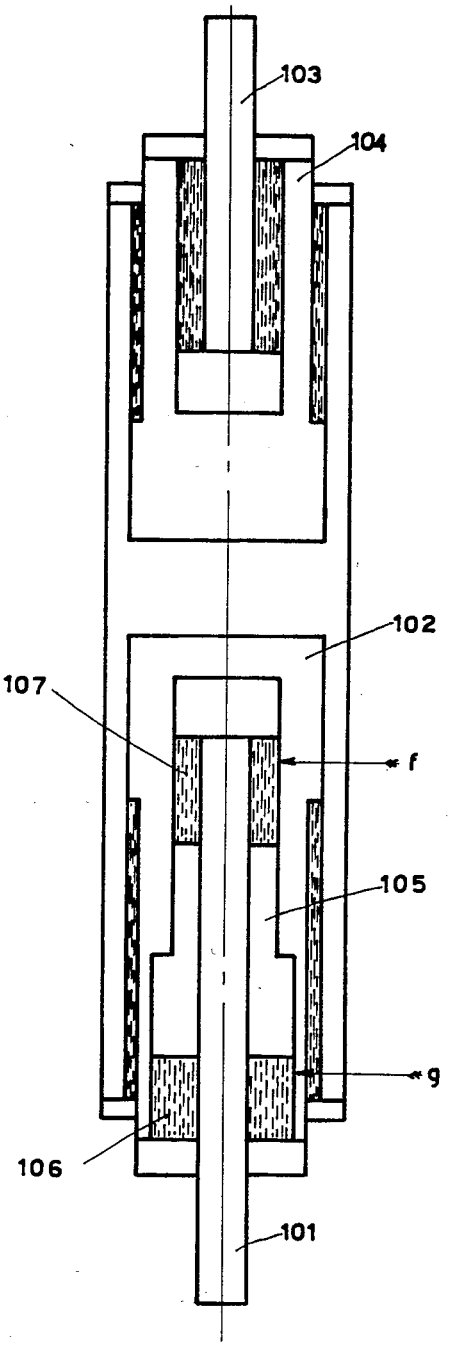
FIG. 5 represents the functional diagram of the set of cylinders lifting the template stack.

So, the operation of the machine is as follows:

the template corresponding to the number of the last actually used in the work cycle is selected, and the template stack will adjust automatically its height so as to position the selected template to the height of feeler pins 4: then the control system causes a to-and-fro motion of the support 58 by means of the motor 61, which will stop when the microswitch 62 comes in contact with the ladder 69. It is obvious that if the template stack is displaced by a length corresponding to one number, an adjacent step will be positioned under the microswitch 62 and consequently, as the support 58 is always performing the to-and-fro motion, the support will stop in a position which differs from the preceding by a length corresponding to the depth of the step. The positioning system of the templates works as follows: on the carriage 2 is positioned the support 63 of the template stack, which slides on the guides 65 by means of rods 66. The support 63 is lifted by a set of actuators, which consists of a series of four actuators in cascade, one of which has a double stroke, as it will be later specified; every actuator has a a different stroke and with the combination of the strokes it is possible to obtain all the twenty positions of the templates. The system is shown in FIG. 5, where are seen the four actuators 101, 102, 103, 104; this is a specific arrangement of known telescopic cylinders.

Actuator 101 has however a peculiar characteristic, since it can execute two strokes of different lengths.

The feature is obtained as follows: actuator 102 has an inner chamber with two diameters; in the chamber slides the piston 101 and the mobile retainer 105 keeping the chamber 106 under pressure, actuator 101 is allowed to execute a stroke corresponding to the length of chamber 107, while eliminating the pressure from chamber 106, the actuator 101 will execute a stroke equal to the total length of the two chambers 106 and 107.

This device allows to save quite a lot of space, because for a given stroke the overall dimension of the cylinders set is very reduced.

Figure 6:
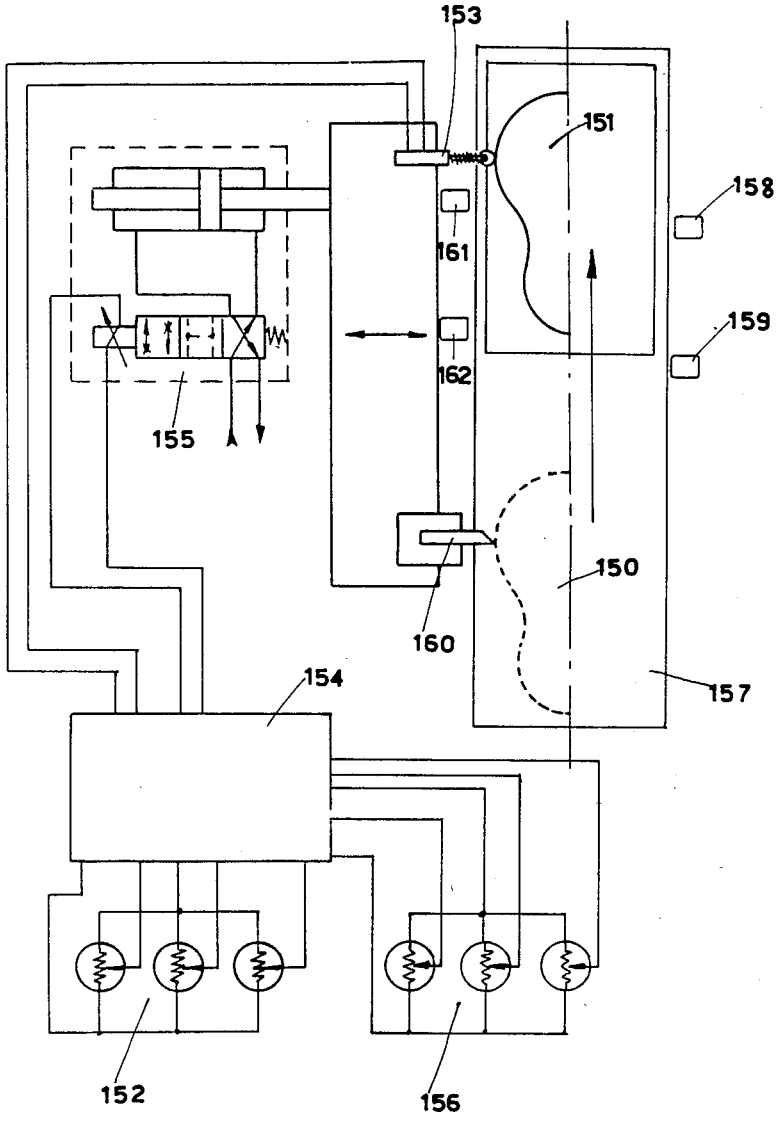
FIG. 6 represents the functional diagram of the profile-copying system.

The functional diagram of the profile-copying system is shown in FIG. 6, where we may see the last 150 used in the actual manufacturing cycle, the corresponding template 151, the feeler pin 153 with a transducer, the electronic microprocessor 154, the hydraulic valve 155 with its interlocked motor, the potentiometers 152 and 156 to modify the trajectory relatively to the theoretical one given by the template, the main carriage 157, the microswitchs 158, 159, 161, 162 connected to the potentiometers, the working tool 160.

The machine may be provided with other series of potentiometers, to perform particular functions.

The functional principle of the profile-copy system is the following: the carriage 157 moving in the direction of the arrow brings the template 151 in touch with the feeler-pin 153; the feeler-pin, with its movement, acts on the slide of the transducer generating an "error" signal, which the electronic apparatus processes and tries to reduce to zero, by giving to the unit 155 instructions to operate in such a way as to oppose the "error" signal.

This system is known as a "tracking system".

It has peculiar characteristics, i.e. the possibility to modify the tool trajectory relatively to the trajectory given by the template, by means of corrective signals generated by the potentiometers, as described and claimed in a co-pending patent application of the same applicant.

Variations, modifications and changes may be applied to the actual construction of the present machine for the automatic carding of uppers, remaining within the essence of this invention, and without leaving its protected domain.

We claim:

1. A machine for the automatic carding of uppers for footwear, comprising:

a bedplate provided with longitudinal guides, said bedplate having a symmetry axis;

a carriage moving along said longitudinal guides and means associated with said carriage for positioning and locking a last with its uppers, and having a system for positioning and locking a template stack;

a first tool-holder unit, fixedly connected to said bedplate and provided with a rocking arm supporting a tool at its free end, and with a system to control the approach and to regulate the pressure;

two similar tool-holder units, movable at a right angle relatively to said symmetry axis of said bedplate provided with said longitudinal guides along which said carriage slides, and symmetrically positioned with reference to said symmetry axis of said bedplate; each said tool holder unit including a rocking arm supporting said tool, and a system to regulate the pressure between said tool and upper;

a profile-copying "tracking" system including a template, a transducer, a feeler pin sliding on said template, and an electronic microprocessor, said profile-copying tracking system actuating the movement of each movable tool-holder unit, according to the signal given by said feeler-pin sliding on said template, by way of said transducer and said electronic microprocessor.

2. A machine according to claim 1, wherein said means for positioning and locking said last with the uppers comprises a device for locking the last in the heel area and another device to support the toe; said last-mentioned means including means for identifying whether the last is right or left.

3. A machine according to claim 2 wherein the system for positioning and locking the template stack comprises a template stack support and, wherein the toe support is fixed to a support connected with an arm operated by an actuator, and is provided at its free end with a microswitch inserting itself into a step of a ladder on which is positioned the support of the template stack.

4. A machine according to claim 2, wherein said positioning and locking means of said last with the uppers comprises two arms hinged and pushed by springs in a closing sense, and by a piston in an opening sense, one lever, pushed by an actuator, which adjusts the height of the last and pushes the toe against a V-shaped support for said toe, and two pads carried by two levers, which, by means of an actuator, grip and lock the last.

5. A machine, according to claim 3, wherein said levers carrying the two pads are connected to an arm operating two laterally positioned microswitches, according to the last being used in the actual manufacturing cycle.

6. A machine according to claim 4 wherein the system for positioning and locking the template stack comprises a template stack support and, wherein the toe support is fixed to a support connected with an arm operated by an actuator, and is provided at its free end with a microswitch inserting itself into a step of a ladder on which is positioned the support of the template stack.

7. A machine according to claim 6, wherein the system for positioning and locking the template stack comprises a template stack support movable by means of four actuators in cascade, one of which may execute a double stroke.

8. A machine according to claim 7, wherein the carding tool is driven in rotation, and the direction of rotation is the same of the folding sense of the upper.

9. A machine according to claim 8, in which the system to regulate the pressure between the tool and the upper comprises a pulley pivoted on the pin of the rocking arm holding the tool, a toothed belt acting on said pulley and tensioned at both ends by two hydraulic actuators, one of them maintained under a constant pressure, and a third actuator moving the rocking arm to a work position, and retracting when the tool has arrived in touch with the upper.

10. A machine according to claim 9 in which the profile-copying "tracking" system comprises a first carriage on which are fixed the template and the upper to be carded, a second carriage on which are fixed the feeler-pin and one of the movable tool-holder units, said transducer being connected to said feeler-pin, an electronic microprocessor connected with said transducer, a valve with an interlocked motor connected to said electronic unit, and potentiometers associated with microswitches to modify, if necessary, the trajectory of the tool with reference to that given by the template.

11. A machine according to claim 1, wherein the system for positioning and locking the template stack comprises a template stack support movable by means of four actuators in cascade, one of which may execute a double stroke.

12. A machine according to claim 1, wherein the carding tool is driven in rotation, and the direction of rotation is the same of the folding sense of the upper.

13. A machine according to claim 1, in which the system to regulate the pressure between the tool and the upper comprises a pulley pivoted on the pin of the rocking arm holding the tool, a toothed belt acting on said pulley and tensioned at both ends by two hydraulic actuators, one of them maintained under a constant pressure, and a third actuator moving the rocking arm to a work position, and retracting when the tool has arrived in touch with the upper.

14. A machine according to claim 1, in which the profile-copying "tracking" system comprises a first carriage on which are fixed the template and the upper to be carded, a second carriage on which are fixed the feeler-pin and one of the movable tool-holder units, said transducer being connected to said feeler-pin, an electronic microprocessor connected with said transducer, a valve with an interlocked motor connected to said electronic unit, and potentiometers associated with microswitches to modify, if necessary, the trajectory of the tool with reference to that given by the template.

15. A machine according to claim 1, wherein said positioning and locking means of said last with the uppers comprises two arms hinged and pushed by springs in a closing sense and by a piston in an opening sense, one lever, pushed by an actuator, which adjusts the height of the last and pushes the toe against a V-shaped support for said toe, and two pads carried by two levers, which, by means of an actuator, grip and lock the last.

16. A machine according to claim 15, wherein said levers carrying said two pads are connected to an arm operating two laterally positioned microswitches, according to the last being used in the actual manufacturing cycle.

17. A machine according to claim 15 wherein the system for positioning and locking the template stack comprises a template stack support and, wherein the toe support is fixed to a support connected with an arm operated by an actuator, and is provided at its free end with a microswitch inserting itself into a step of a ladder on which is positioned the support of the template stack.

* * * * *